US006315192B1

(12) United States Patent
Marlow

(10) Patent No.: US 6,315,192 B1
(45) Date of Patent: Nov. 13, 2001

(54) BLANK FOR A CUP HOLDER

(75) Inventor: Robert Marlow, Flitwick (GB)

(73) Assignee: Colpac Limited, Bedfordshire (GB)

( * ) Notice: Subject to any disclaimer, the term of this patent is extended or adjusted under 35 U.S.C. 154(b) by 0 days.

(21) Appl. No.: 09/839,302

(22) Filed: Apr. 23, 2001

(30) Foreign Application Priority Data

Nov. 14, 2000 (GB) ..... 0027764
Dec. 12, 2000 (GB) ..... 0030261

(51) Int. Cl.[7] ..... B65D 3/22

(52) U.S. Cl. ..... 229/401; 220/738; 220/739; 229/403

(58) Field of Search ..... 229/400, 401, 229/403; 220/737, 738, 739, 903; 206/541, 542

(56) References Cited

U.S. PATENT DOCUMENTS 4,540,611 * 9/1985 Henderson ..... 220/739
5,222,656 * 6/1993 Carlson ..... 229/403
5,251,758 * 10/1993 Kolacek ..... 206/542
5,620,724 * 4/1997 Adler ..... 426/77
5,669,553 * 9/1997 Smith ..... 220/738
5,706,949 * 1/1998 Amato ..... 206/542
5,722,558 * 3/1998 Thompson ..... 206/541
5,746,372 * 5/1998 Spence ..... 229/403
5,842,633 * 12/1998 Nurse ..... 229/403

* cited by examiner

*Primary Examiner*—Gary E. Elkins
(74) *Attorney, Agent, or Firm*—Dykema Gossett PLLC

(57) ABSTRACT

A blank for a cupholder to facilitate handling of cups containing hot beverages has one or more cuts defining a strip or a flap. The strip or flap can be folded relative to the or each cut to define a pocket or opening for receiving and retaining an accessory for the cup or the beverage, such as a spoon or a sachet of sugar.

9 Claims, 5 Drawing Sheets

BLANK FOR A CUP HOLDER

This invention relates to a cup holder to facilitate handling of cups containing hot beverages like hot chocolate, tea, coffee, soup or the like, which are commonly found in fast food establishments and similar shops. The invention relates particularly to cup holders which can be folded flat for transport and storage and easily opened out to receive a cup when required.

Cup holders of this type are known, but the present invention provides an improvement to known cup holders, and according to a first aspect of the present invention there is provided a blank for forming a holder for a cup comprises a strip of card or other flexible material having an upper edge, a lower edge and two end portions, the end portions being securable together such that the holder can be moved between a substantially flat configuration and a tube-like configuration for receiving and retaining, in use, the cup, wherein one or more cuts in the strip allow a strip portion adjacent to the or each cut to be folded relative to the remainder of the strip to define a pocket or opening for receiving and retaining an accessory for the cup or the beverage contained therein.

The accessory held in the pocket or opening may be a spoon to stir the beverage, a sachet of sugar to add to the beverage or any other accessory which might be required in connection with the beverage.

According to one embodiment, a primary cut is provided substantially parallel to the upper and lower edges with the lower lip of the cut being moved outwardly of the holder to define an upwardly opening pocket.

According to a preferred embodiment a first non-linear cut defines a tab, with a foldline extending between the ends of the first cut and the fold line intersecting a pair of generally parallel substantially linear cuts defining therebetween a secondary strip, such that outward movement of the tab, and movement of the secondary strip relative to the tab, defines a channel for receiving and retaining a spoon or other utensil.

According to another embodiment, a pair of cuts have outer edges moveable outwardly of the holder to define confronting orifices for receipt of the basal corners of a sugar sachet or a similar accessory.

According to another aspect of the present there is provided a cup holder formed from a blank according to the first aspect of the present invention.

A clear understanding of the invention will be gained for the following detailed description, given by way of example only, with reference to the accompanying drawings in which.

Figure 1:
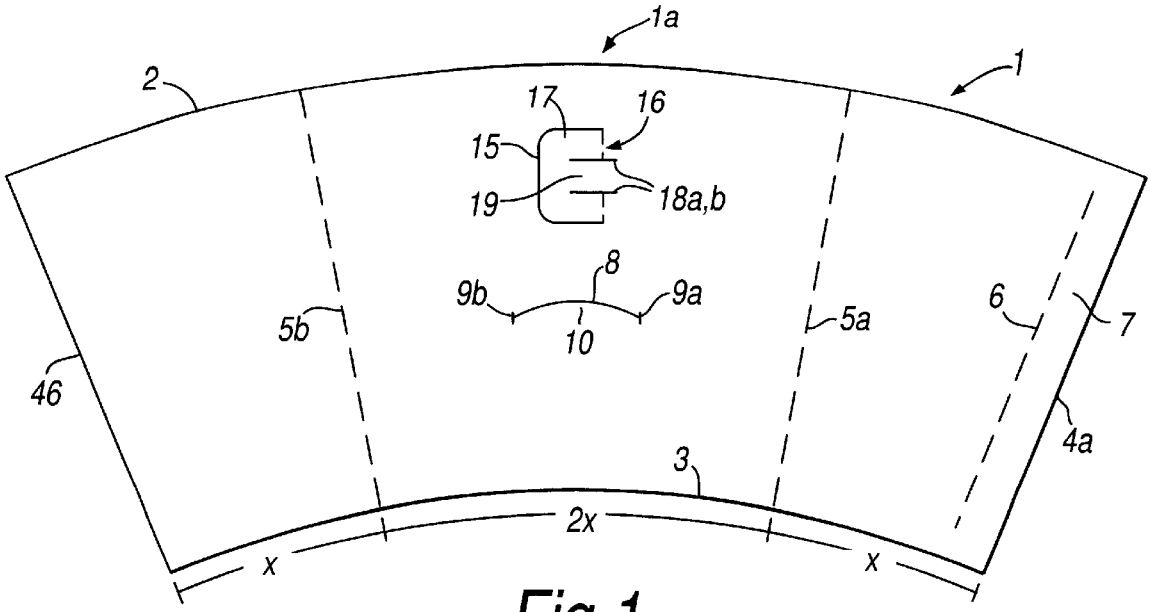
FIG. 1 is a view of a blank according to the present invention.

With reference to FIG. 1, a sector-like blank, generally designated 1, has an upper concave edge 2 and a lower convex edge 3. The upper and lower edges are curved so that they will conform to the outer circumferential surface of a cup 29 received in the holder, the cup having a generally frusto-conical outer shape with a large diameter at the upper, open end 30. The radius of curvature of the upper and lower edges 2,3 of the blank 1 are centred on a primary imaginary centre point, with the linear end edges 4*a,b* of the blank 1 lying on radii to the same imaginary centre point.

The blank 1 is preferably fabricated by die cutting a sheet of stiffened paper, paper board, corrugated cardboard, plastics or similar flexible sheet material.

Foldlines 5*a,b* also lie on lines of radius emanating from said primary imaginary centre point, and are disposed a distance of approximately one quarter the length of the blank from their nearest end edge. Small cuts at the ends of foldlines 5*a,b* aid accuracy of the subsequent fold. A further foldline 6 is disposed adjacent an end edge 4*a*. The further foldline 6 lies parallel to said end edge 4*a* and defines together with the end edge 4*a* an overlapping portion 7. The further foldline 6 relieves stress on the join between the ends of the blank when they are secured together.

The central portion of the blank 1*a* has a series of cuts or slots, which, in use, define pockets for receiving one or more accessories. The lower cut arrangement, as shown in FIG. 1, comprises an arcuate primary slot 8 with a slots 9*a,b* generally orthogonal to and centred on the ends of the primary slot 8. The radius of curvature of the slot 8 is centred on a second imaginary centre point disposed on or in the direction of the lower edge 3 such that the lower lip 10 can be opened outwardly of the holder to form an upwardly opening pocket 11 (see FIG. 4). The pocket 11 is particularly suited for receiving a sugar sachet or the like.

The upper cut arrangement, as shown in FIG. 1, has a first generally c-shaped slot or cut 15. The ends of the slot 15 lie on a foldline 16 that is disposed on a radius of the primary imaginary centre point and is orientated with the vertical when the cup holder is held in an upright position. The foldline 16 and the slot 15 define together a tab 17. Two parallel spaced apart slots or cuts 18*a,b* are positioned to intersect the foldline 16 and are orientated generally at right angles to the foldline 16. The two slots 18*a,b* define, secondary strip or link 19.

Figure 2:
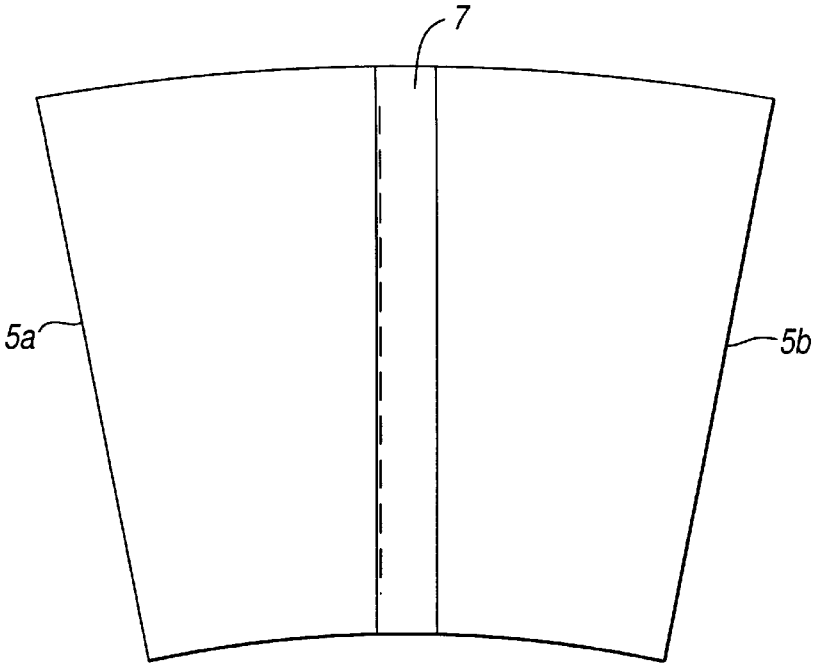
FIG. 2 is a rear view of the blank of FIG. 1 assembled and in a substantially flat condition.

As shown in FIG. 2, the blank is assembled into a cup holder by folding the blank 1 about foldlines 5*a,b* so that end portion 7 overlies the free end 4*b* of the blank. The overlapping portions of the blank are preferably secured together by means of a suitable adhesive, but any other suitable mechanical or chemical fastening mechanism could be employed. The cup holder can be kept in a substantially flat condition as shown in FIG. 2 until it is to be put to use when lateral inward pressure to the foldlines 5*a,b* cause the holder to open into a generally frusto-conical form suitable for receiving a cup 29.

Before the cup is placed in the holder the lower lip 10 of the lower cut arrangement can be pushed outwardly of the holder in the direction of arrow A to provide a first pocket 10, particularly suited for receipt of a sugar sachet or the like. Similarly, tab 17 can be pivoted outwardly of the holder in the direction of arrow B; at the same time, outward pressure against the inside of secondary strip 19 will cause the strip to stand proud of the surface of the holder, and together with the tab, define a pocket or channel 20 suited for receiving a utensil such as a spoon or a sugar stick.

Figure 5:
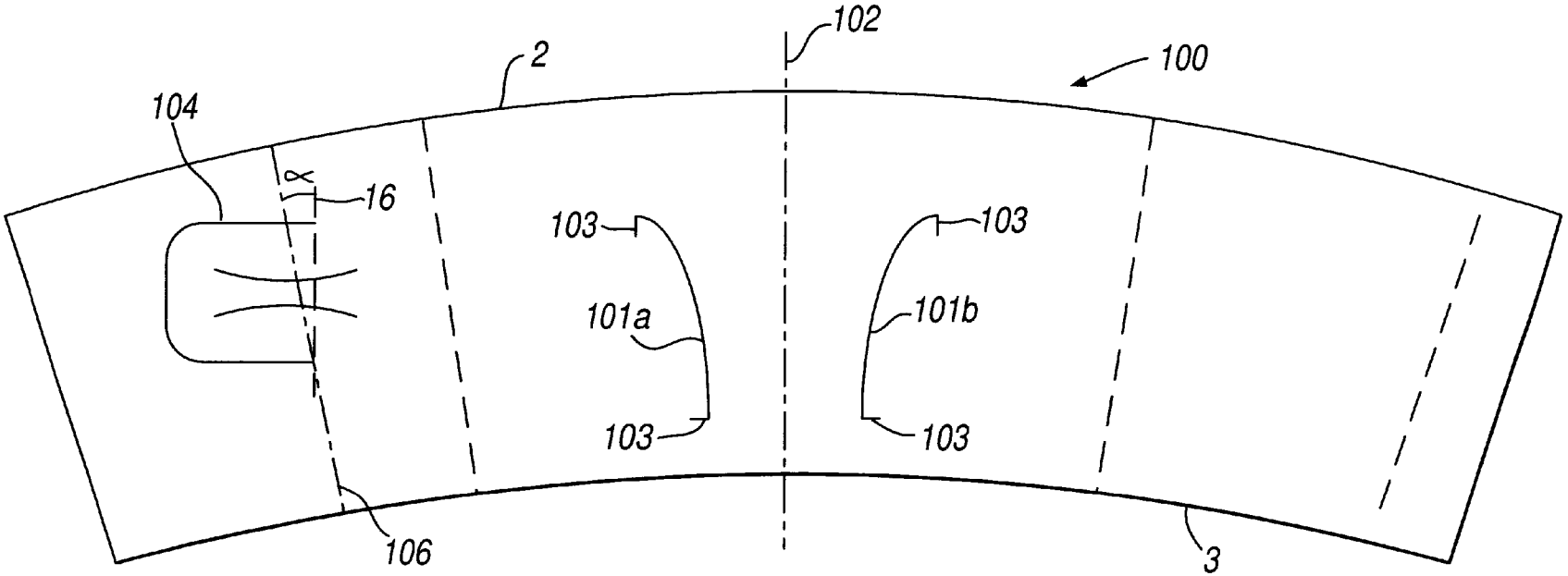
FIG. 5 is a modified blank according to the invention.

With reference to FIG. 5, the sector-like blank 100, has a first modified cut arrangement comprising a pair of arcuate slots 101 *a,b*. The lower ends of the slots 101*a,b* are generally parallel with the vertical centre line of the blank 102, and curve upwardly and outwardly to lie generally orthogonal to the centre line 102 at their upper extremities. Minor cuts 103 extend from the ends of the slots 101*a,b* in a direction substantially at right angles to a tangent to the slot at the point of intersection of the slots 101 and the minor cuts 103. Imaginary lines extending through the end points of the cuts 101 meet at a point on the centre line 102 in the region of or below the lower edge 3 of the blank 100.

Figure 6:
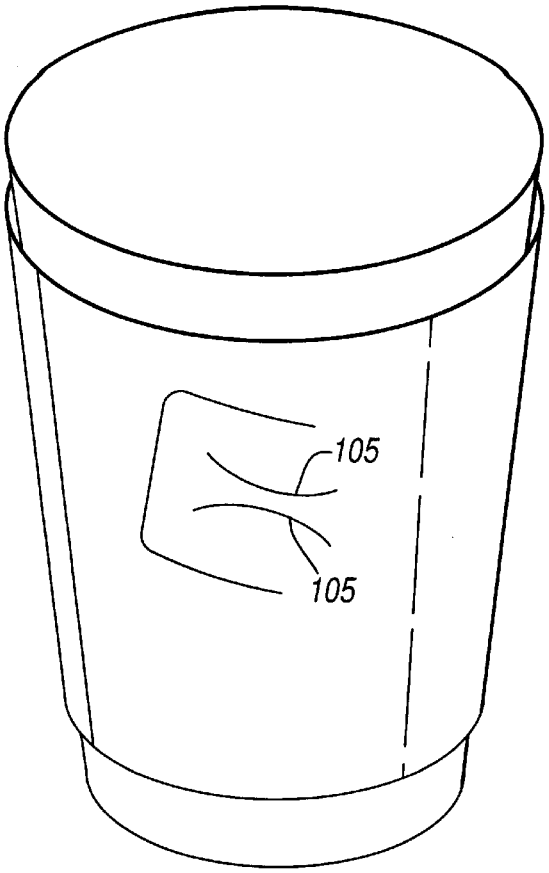
FIGS. 6, 7, 8 and 9 are perspective views of the blank of FIG. 1 assembled and in an open condition holding a cup.
Figure 7:
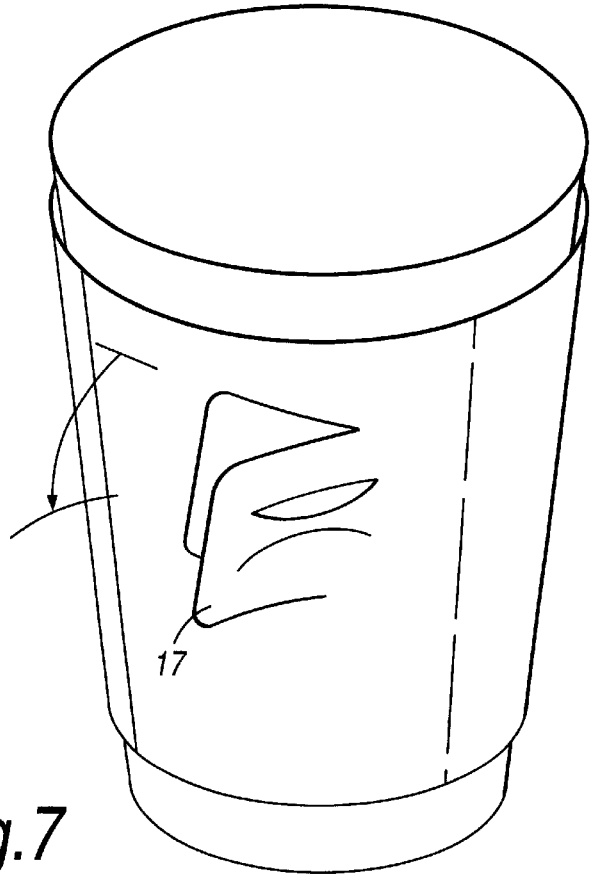

A second modified cut arrangement shown in FIGS. 6 and 7 has a generally C-shaped slot or cut 104. Two slots or cuts 105 intersect a foldline 16 which is inclined at an acute angle to reference line 106 defining the shortest distance between the upper and lower edges 2,3 in the region of the cut foldline 16.

The foldline is preferably inclined at an angle of 10° to 35° to the reference line 105. The slots 105 define a secondary strip or link 19 which tapers in from each end to a central waistpoint.

Figure 3:
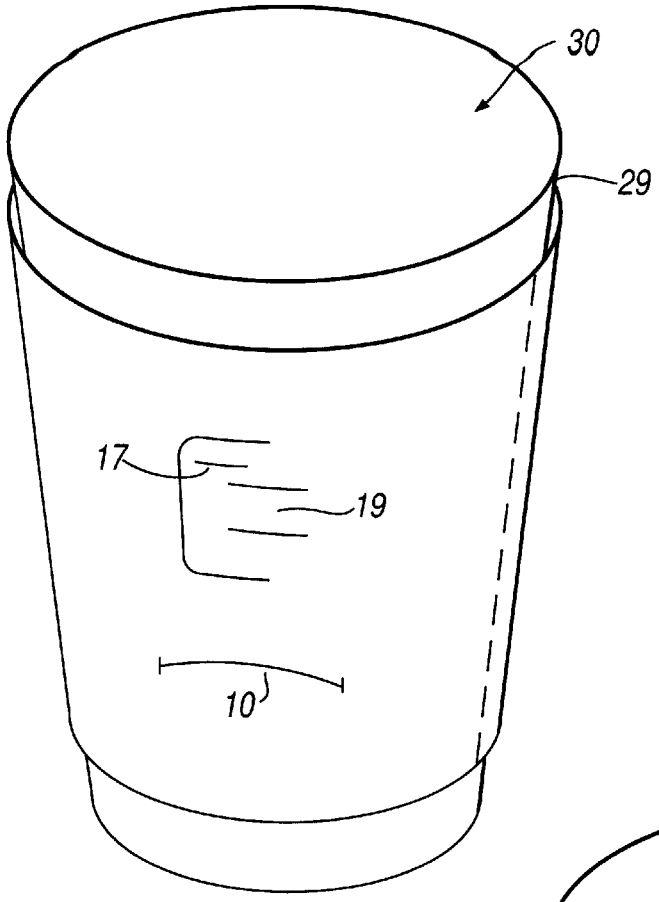
FIG. 3 is a perspective view of the blank of FIG. 1 assembled and in an open condition holding a cup.
Figure 4:
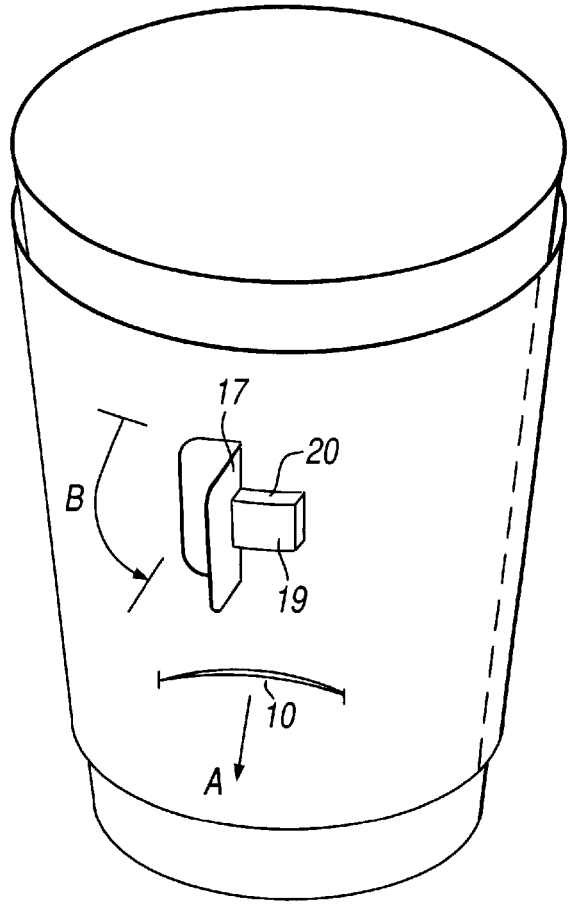
FIG. 4 is a similar view to FIG. 3 showing the opened pockets.

In use, the second modified cut arrangement operates in a similar manner to the upper cut arrangement depicted in FIGS. 1, 3 and 4 and described above, but the angulation of the foldline 16 relative to the reference line 106 improves the retention of the utensil or sugar stick.

Figure 8:
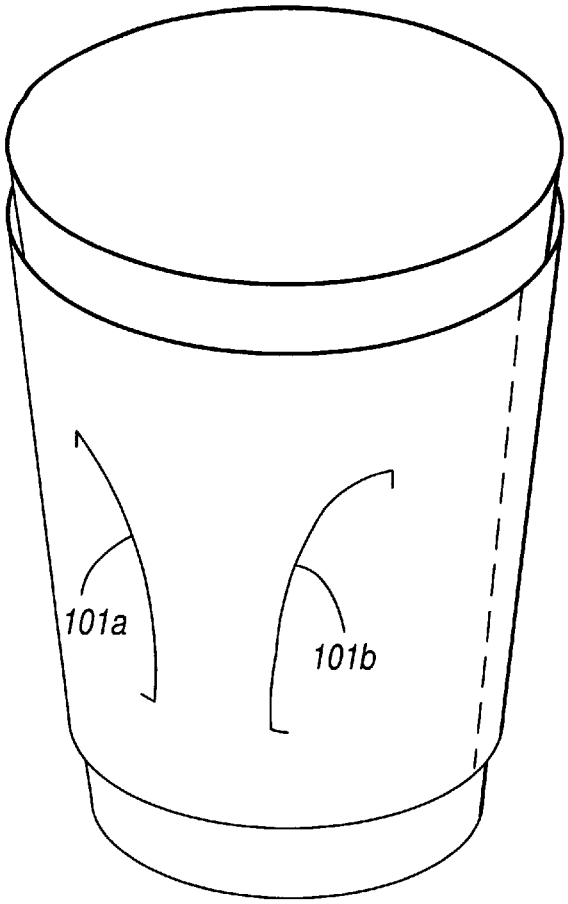
Figure 9:
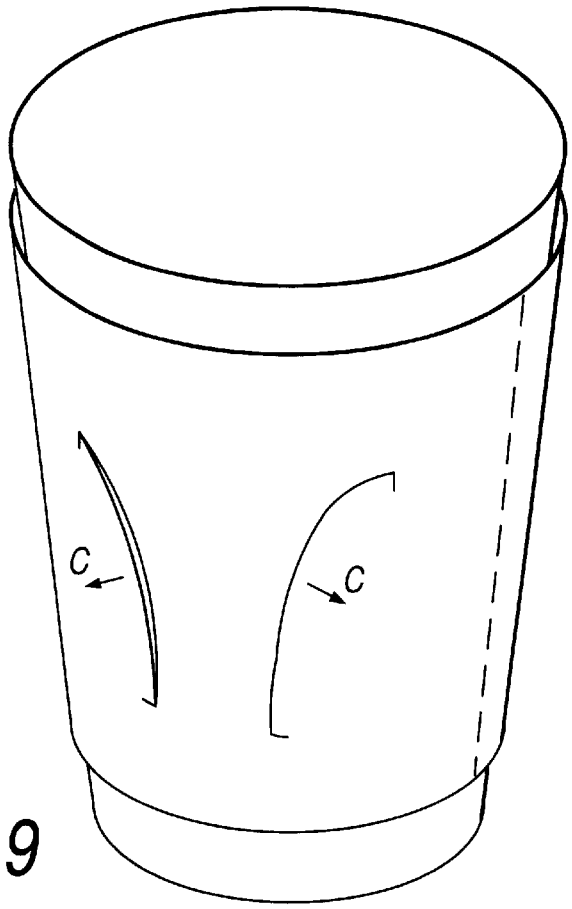

The first modified cut arrangement, shown in FIGS. 8 and 9, has the outer edges of the cuts or slots 101*a,b* moved in the direction of arrows C outwardly of the holder to provide two confronting pockets. A lower edge of a sugar sachet can be secured in each pocket. The minor cuts at the ends of the slot 101*a,b* facilitate opening of the pockets and reduce the chances of the ends of the slot being torn or damaged and thereby reducing the efficacy of the pocket.

Of course a skilled man will appreciate modifications to the above described embodiment can be made without departing from the scope of the following claims. For instance, the cut 15 need not necessarily be c-shaped, and the slot 8 could be linear.

What is claimed is:

1. A blank for forming a holder for a cup comprises a strip of card or other flexible material having an upper edge, a lower edge and two end portions, the end portions being securable together such that the holder can be moved between a substantially flat configuration and a tube-like configuration for receiving and retaining, in use, the cup, wherein one or more cuts in the strip allow a strip portion adjacent to the or each cut to be folded relative to the remainder of the strip to define a pocket or opening for receiving and retaining an accessory for the cup or the beverage contained therein.

2. A blank according to claim 1, wherein a primary cut is provided substantially parallel to the tipper and lower edges with the lower lip of the cut being moved outwardly of the holder to define an upwardly opening pocket.

3. A blank according to claim 2, wherein the primary cut is arcuate with the centre of curvature of the cut being disposed in the direction of the lower edge of the strip.

4. A blank according to claim 2 wherein secondary cuts are provided at each end of the primary cut to facilitate opening of the pocket.

5. A blank according to claim 4, wherein the secondary cuts are disposed substantially orthogonally to the primary cut.

6. A blank according to claim 1, wherein a first non-linear cut defines a tab, with a foldline extending between the ends of the first cut and the foldline intersecting a pair of a generally parallel substantially linear cuts defining therebetween a secondary strip, such that outward movement of the tab, and movement of the secondary strip relative to the tab, defines a channel for receiving and retaining a spoon or other utensil.

7. A blank according to claim 6, wherein the first cut is generally c-shaped.

8. A blank according to claim 1, wherein a pair of cuts have outer edges moveable outwardly of the holder to define confronting orifices for receipt of the basal corners of a sugar sachet or a similar accessory.

9. A cup holder formed from a blank according to claim 1, wherein the end portions are secured together.

* * * * *